US006675417B2

(12) United States Patent
Spector et al.

(10) Patent No.: US 6,675,417 B2
(45) Date of Patent: Jan. 13, 2004

(54) PILLOW TO AID CONCEPTION

(76) Inventors: Daniela Spector, 14 Nirvana Ave., Great Neck, NY (US) 11023; Juval Spector, 14 Nirvana Ave., Great Neck, NY (US) 11203

( * ) Notice: Subject to any disclaimer, the term of this patent is extended or adjusted under 35 U.S.C. 154(b) by 0 days.

(21) Appl. No.: 10/137,900

(22) Filed: May 2, 2002

(65) Prior Publication Data

US 2003/0204912 A1 Nov. 6, 2003

(51) Int. Cl.[7] ..... A47C 20/00
(52) U.S. Cl. ..... 5/630; 5/632; 5/929
(58) Field of Search ..... 5/630, 929, 648, 5/652, 655.9, 657; 128/845; 600/38

(56) References Cited

U.S. PATENT DOCUMENTS 3,813,091 A * 5/1974 Metzger ..... 5/613
3,843,980 A * 10/1974 Rodriguez ..... 5/733
4,528,706 A * 7/1985 Branker ..... 5/722
6,360,387 B1 * 3/2002 Everhart ..... 5/630

* cited by examiner

*Primary Examiner*—Teri Pham Luu
(74) *Attorney, Agent, or Firm*—Scully, Scott, Murphy & Presser

(57) ABSTRACT

A device is provided for aiding in conception. The device includes a wedge section with a top inclined face, a flat bottom face, and depending side faces. The top face is inclined in order to support and raise the lower torso of a female while keeping the upper torso flat. Also provided is a three-dimensional contoured member placed on the inclined top face of the wedge section to support and hold the buttocks of the female during sexual intercourse.

13 Claims, 2 Drawing Sheets

PILLOW TO AID CONCEPTION

BACKGROUND OF THE INVENTION

1. Field of the Invention

The present invention relates to a therapeutic pillow, and more specifically, to an apparatus capable of elevating the lower torso of a female to help aid in conception.

2. Prior Art

Generally, pillows are made to support anatomical parts of a human being including the head, back, shoulders and tailbone. These devices are created to reduce the stress induced on these parts of the body and to relieve the tension in these parts of the body.

However, none of these pillows are configured in a manner so as to aid in helping increase the chances of conception. Pillows have always been adapted to support other parts of the body, such as the head and shoulders, for a more comforting sleep and to relieve stress. These pillows are not devised to support and incline the lower torso of a female body relative to her upper torso in the manner such as provided in the present invention.

There are, of course, other products in the market used to aid in conception, e.g., fertility pills, ovulation kits, etc., but none of these are directed towards the specific task of raising and supporting the lower torso of a female relative to the upper torso in order to help increase the chances of conception such as the present invention.

SUMMARY OF THE INVENTION

In view of the several disadvantages of prior conception aids and ordinary pillows, the present invention provides a therapeutic device to aid in conception. It is a purpose of the present invention to provide an apparatus for lifting and supporting the lower torso of the female during and after sexual intercourse to help increase the chances of conception. The specific inclined position achieved by the present invention provides for semen to travel efficiently from the vagina through the uterus and fallopian tubes to the ampullae of the fallopian tubes. This process is aided by the gravitational force the present invention brings to bear on the semen after ejaculating into the vagina and the opening the course the semen flows through.

Accordingly, an apparatus for supporting and raising the lower torso of a female is provided. The apparatus comprises a wedge section used to elevate and support the lower torso of the female that comprises a planar base and a planar top, which are connected by depending sides. The top of the wedge section is inclined relative to the base of the wedge section. An additional three-dimensional contoured member with bulbous sides and a restricted center may be connected to the top section, which provides for direct support of the buttocks, so the pudendum of the female is higher than and inclined relative to the upper torso of the female.

The apparatus preferably further comprises an oval support section that connects to the three-dimensional contoured member across its narrowed center to impart an additional lift to the pudendum.

Also provided is a method of supporting the lower torso of a female lying prone on her back in an elevated position. The method comprises elevating the lower torso and supporting the buttocks of a female with a therapeutic device designed and configured so the pudendum of the female is higher and inclined compared to her upper torso.

The method preferably further comprises imparting an additional lift to the pudendum using an oval support section that attaches to the therapeutic device.

BRIEF DESCRIPTION OF THE DRAWINGS

These and other features, aspects, and advantages of the apparatus and methods of the present invention will become better understood due to the following description, appended claims, and accompanying drawings where:

DETAILED DESCRIPTION OF THE PREFERRED EMBODIMENT

Figure 1:
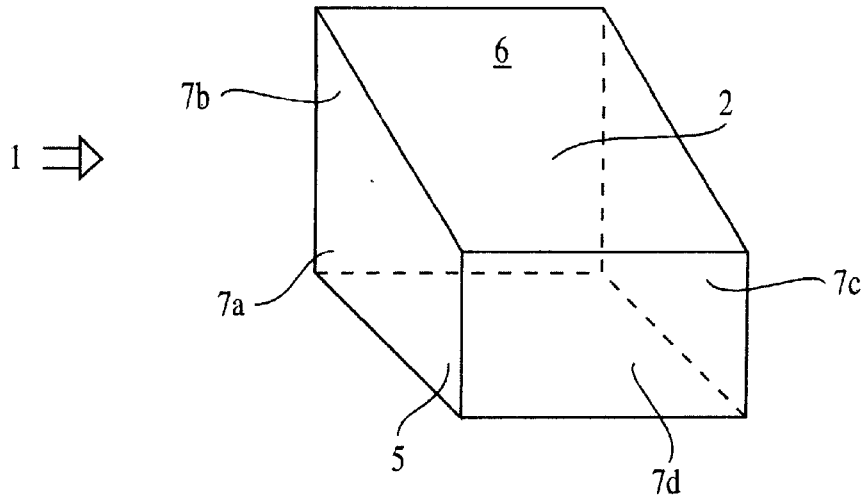
FIG. 1 is a perspective view of the preferred embodiment of the present invention constructed in accordance with the principles of the present invention.

With reference now to the drawings, and particularly to FIG. 1, the present invention will be described in its preferred embodiment.

FIG. 1 is a cross-sectional view of the wedge section 1 of the present invention. The wedge section I has a top 2 and a bottom 5, which are connected by four depending sides 7*a*, 7*b*, 7*c* and 7*d*. The top 2 of the wedge section 1 is inclined relative to the bottom 5 of the wedge section 1 and has a point 6. Each side, top, bottom and depending, are all substantially planar.

Figure 2:
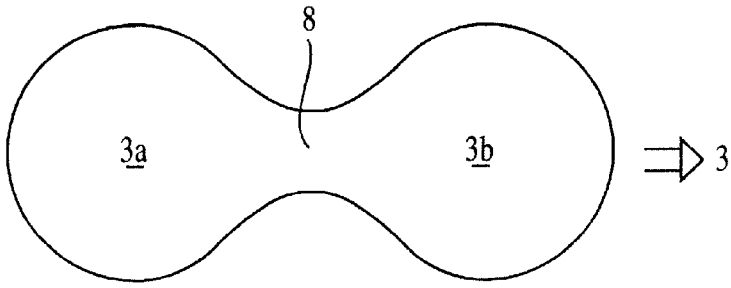
FIG. 2 is a perspective view of the wedge section of the present invention.

FIG. 2 is a front view of the three-dimensional contoured member of the present invention. This member has a left bulbous side 3a and a right bulbous side 3*b*, and a restricted center at point 8. Preferably, the center 8 of this member is attached to the wedge section 1 of FIG. 1 at point 6.

Figure 3:
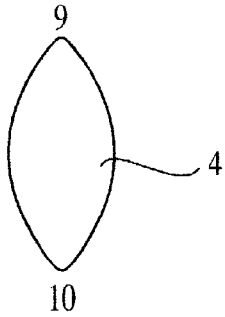
FIG. 3 is a front view of the three-dimensional contoured member of the present invention, which is preferably placed on top of the wedge section of FIG. 2.

FIG. 3 is a front view of an oval support section with end points 9 and 10. Preferably, the oval support section comprises firm foam and attaches from points 9 and 10 to the restricted center 8 of the three-dimensional contoured member of FIG. 2.

Figure 4:
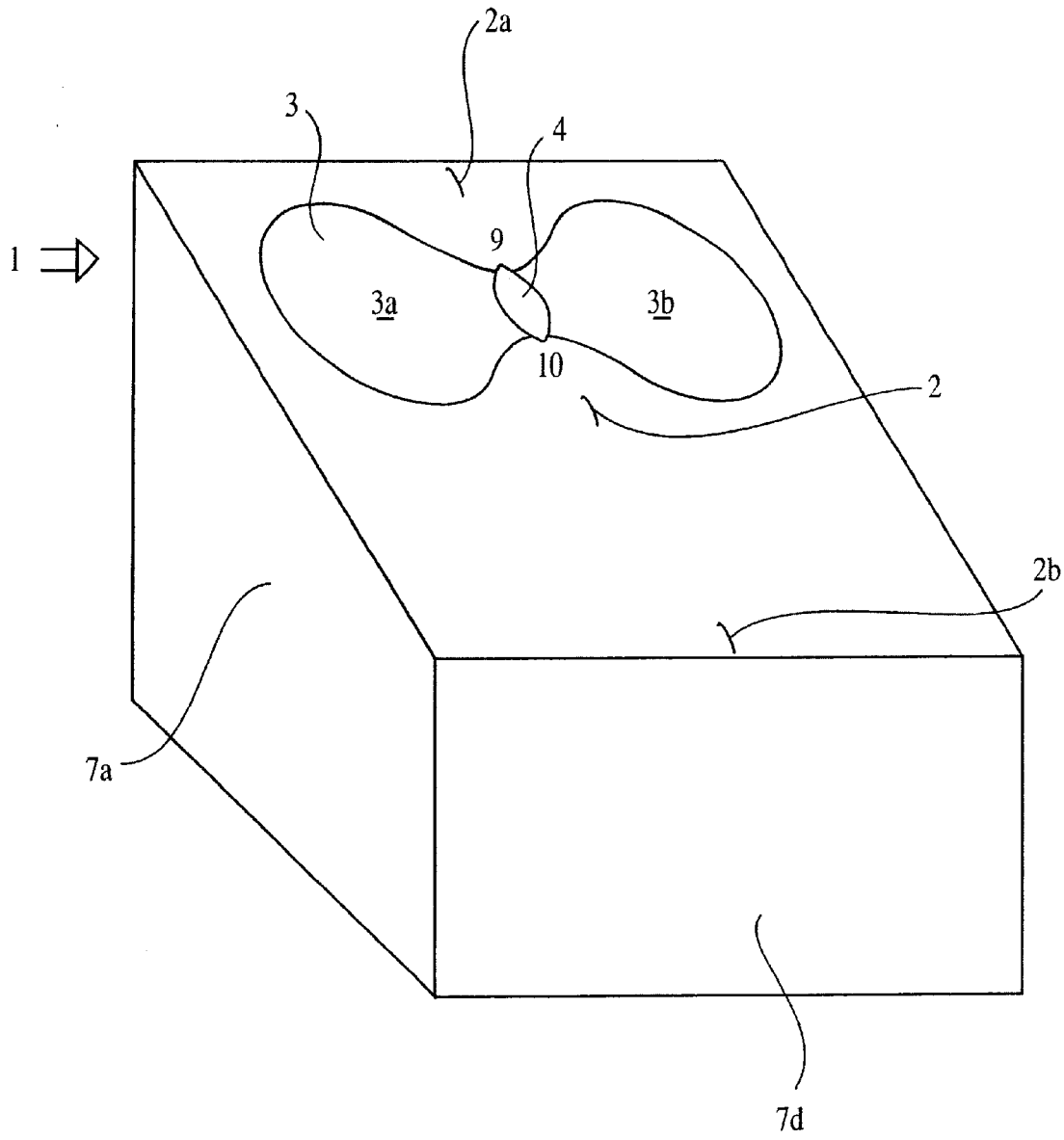
FIG. 4 is a front view of an oval support section, preferably used with the three-dimensional contoured member of FIG. 3.

Referring now to FIG. 4, an apparatus for elevating and supporting the lower torso of a female to help aid in conception is illustrated. Though many different variations of this device are possible, FIG. 4 illustrates a preferred embodiment of the present invention.

Preferably the apparatus is placed on a bed, floor, or other flat surface during sexual intercourse. The wedge section 1 is used to elevate and support the buttocks of the female in a missionary position during intercourse. The female's legs hang over the higher inclined section 2*a* and side 7*b* of the wedge section 1, thereby elevating her lower torso, and her upper torso lies lower over the lower section 2*b* of the wedge section 1.

The three-dimensional contoured member 3 is connected securely to the top 2 of the wedge section 1. Preferably, the three-dimensional contoured member is attached using Velcro or some adhesive it may also be integrated into the wedge section 1. The three-dimensional contoured member is soft yet supportive for immediate contact with both cheeks of the buttocks. The bulbous side 3*b* supports the right cheek of the buttocks and the bulbous side 3*a* supports the left cheek of the buttocks. This three-dimensional contoured member 3 supports and holds the buttocks in place during sexual intercourse in a missionary position.

Preferably, an oval support section 4 is also attached to the center of the three-dimensional contoured member 3 at points 9 and 10. This oval support section 4 adds an additional lift to the pudendum and also helps keep semen from overflowing, thereby increasing the chances of conception. By imparting an additional lift to the pudendum, the present invention is aided by gravity in carrying the semen flow from the vagina to the fallopian tubes.

The present invention provides several advantages that solve the problems with prior art inventions. It provides a therapeutic device designed and configured with a shape and support that no other pillow provides a female and increases her chances of conception. Also, it is different from other fertility aids in that it provides better positioning of the female during and after intercourse to aid in conception. The present invention provides a therapeutic device that will raise and support the lower torso of the female in a manner such that her lower torso will remain inclined compared to her upper torso. By achieving such a position, the semen, with the aid of gravity, will flow through the vagina after ejaculation, and through the fallopian tubes to the ampullae of the fallopian tubes. The female can comfortably lay on the device during intercourse, and as long as she needs to after, to increase her chances of conception.

The present invention may be made of different materials. For example, the wedge section 1, three-dimensional contoured member 3, and oval support section 4 may be made up of a cloth bag filled with feathers, as in a regular pillow, or could be made of foam or even a plastic or rubber inflatable material.

The above description of the present invention is only the preferred embodiment of the invention. There are several other uses of the pillow. The present invention enables overweight people to have sexual intercourse in a missionary position easier and have a more pleasing sex life. The apparatus can be used by people to enjoy sexual intercourse and use the device to aid the stimulation of the so-called "G-spot", or just for medical purposes in keeping the buttocks elevated after insemination. There are several other uses of the invention not limited by the preferred description and embodiment as described above.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A therapeutic device for supporting the lower torso of a female lying prone on her back in an elevated position comprising:

a wedge section to elevate and support the lower torso of the female comprising a planar base and a planar top connected by depending sides which provide for the planar top to be inclined relative to the planar base; and a three-dimensional contoured member with bulbous sides and restricted center that connects to the planar top providing direct support for the buttocks wherein the pudendum of the female is higher than and inclined relative to the upper torso of the female.

2. A therapeutic device according to claim 1, further comprising:

a an oval support section that connects to the three-dimensional contoured member on top of and across its restricted center to impart an additional lift to the pudendum.

3. A therapeutic device according to claim 2, wherein the oval support section is made of a cloth bag filled with feathers.

4. A therapeutic device according to claim 2, wherein the oval support section is made of a foam material.

5. A therapeutic device according to claim 2, wherein the oval support section is made of an inflatable plastic or rubber material.

6. A therapeutic device according to claim 1, wherein the three-dimensional contoured member is made of a cloth bag filled with feathers.

7. A therapeutic device according to claim 1, wherein the three-dimensional contoured member is made of a foam material.

8. A therapeutic device according to claim 1, wherein the three-dimensional contoured member is made of an inflatable plastic or rubber material.

9. A therapeutic device according to claim 1, wherein the wedge section is made of a cloth bag filled with feathers.

10. A therapeutic device according to claim 1, wherein the wedge section is made of a foam material.

11. A therapeutic device according to claim 1, wherein the wedge section is made of an inflatable plastic or rubber material.

12. A method of aiding conception, the method comprising:

elevating the lower torso of a female lying prone on her back;

supporting the lower torso of the female with a therapeutic device designed to support the buttocks and keep the pudendum of the female higher and more inclined compared to the upper torso the device comprising a wedge section comprising a planar base and a planar top connected by depending sides and a three-dimensional contoured member with bulbous sides and a restricted center connected to the wedge section.

13. A method of aiding conception of claim 12, further comprising imparting an additional lift to the pudendum of the female by using an oval support section that connects to the contoured member.

* * * * *